US007454849B2

(12) United States Patent
Romero-Sanchez

(10) Patent No.: US 7,454,849 B2
(45) Date of Patent: Nov. 25, 2008

(54) ANTI-SLIPPING AND SHOCK-ABSORBING ELEMENT FOR SHOE SOLES AND SHOE SOLE INCORPORATING SUCH ELEMENT

(75) Inventor: Juan Carlos Romero-Sanchez, Salinas (ES)

(73) Assignee: Calzados Anatomicos Calana, S.A. (ES)

( * ) Notice: Subject to any disclaimer, the term of this patent is extended or adjusted under 35 U.S.C. 154(b) by 230 days.

(21) Appl. No.: 11/181,070

(22) Filed: Jul. 14, 2005

(65) Prior Publication Data

US 2006/0156585 A1 Jul. 20, 2006

(30) Foreign Application Priority Data

Jan. 14, 2005 (ES) ..... 200500058

(51) Int. Cl.
*A43C 15/00* (2006.01)

(52) U.S. Cl. ..... 36/59 R

(58) Field of Classification Search ..... 36/59 R, 36/59 C, 8.1

See application file for complete search history.

(56) References Cited

U.S. PATENT DOCUMENTS

| | | | | |
|---|---|---|---|---|
| 96,452 | A | 11/1869 | Loper | |
| 238,441 | A | 3/1881 | Sachs | |
| 1,653,059 | A * | 12/1927 | Nelson | 36/59 C |
| D121,469 | S | 7/1940 | Fern | |
| 2,252,216 | A | 8/1941 | Sterzik | |
| D133,172 | S | 7/1942 | Block | |
| 2,364,763 | A | 12/1944 | Sutcliffe | |
| 2,755,567 | A | 7/1956 | Rudine | |
| 4,104,754 | A | 8/1978 | Almao | |
| 4,146,981 | A | 4/1979 | Renaldo | |
| D255,842 | S | 7/1980 | Goldman | |
| D255,843 | S | 7/1980 | Goldman | |
| D270,680 | S | 9/1983 | Jansson | |
| D433,556 | S | 11/2000 | Merceron | |
| 6,209,226 | B1 * | 4/2001 | Squadroni | 36/3 B |
| 6,282,813 | B1 * | 9/2001 | Squadroni | 36/3 B |
| 6,389,712 | B1 | 5/2002 | Schelling | |
| 6,571,491 | B2 | 6/2003 | Safdeye et al. | |
| D482,851 | S | 12/2003 | McClaskie | |
| 2002/0152638 | A1 | 10/2002 | Safdeye | |
| 2002/0157281 | A1 | 10/2002 | Safdeye | |
| 2002/0166261 | A1 | 11/2002 | Safdeye | |

* cited by examiner

*Primary Examiner*—Ted Kavanaugh
(74) *Attorney, Agent, or Firm*—Adams Intellectual Property Law, P.A.

(57) ABSTRACT

The invention refers to an element (2) in the form of a stud (1) incorporating anti-slipping and shock-absorbing means, which is foreseen as generally cylindrical hollow body with a predetermined wall thickness, selected to be compressed under the weight of the user, and with an outer part (3) with an upper base (4) separated from the sole (1), with a plurality of protuberances (7) of a small height and a depression or cavity (8) with the same configuration as the upper base, but slightly off-centred with respect to such upper base and with a lower portion (6) in the form of a cavity, where a plurality of pins (10), essentially in the form of a finger are evenly distributed. A surrounding notch (9) is arranged around the lower base (5) of the outer portion (3). The upper base (4) comprises at least a groove (11) to evacuate water, extending from the cavity (8) towards the outer edge.

5 Claims, 2 Drawing Sheets

ANTI-SLIPPING AND SHOCK-ABSORBING ELEMENT FOR SHOE SOLES AND SHOE SOLE INCORPORATING SUCH ELEMENT

TECHNICAL FIELD AND BACKGROUND OF THE INVENTION

The present invention relates to the shoe manufacturing industry and, more specifically, to items for a shoe sole that provide greater safety and comfort to such shoes due to their adherence and shock-absorbing effect.

Many systems are already known to produce shoe soles with anti-slipping characteristics. However, most of them are addressed to the professional or sports sectors which require shoes with a high degree of adherence, such as fishers, climbers, etc. Specifically, document ES-U 1000599 should be mentioned which describes a sole for sports footwear that presents in its front part a series of concave hollow areas that act as a suction pad. This suction pad effect is also reflected in document ES-U 246026 which describes an improved sole for sports footwear with a concave central area that acts as a suction pad. This suction pad effect is also described in document ES-U 246522. However and despite the fact that the suction pad effect undoubtedly provides adherence to the floor, presents a critical problem not solved yet and related to the loss of efficiency when the surface on which the user walks presents an accumulation of water as a result of the impossibility of evacuating the water stored underneath the suction pad.

Similarly, footwear able to be used under extreme circumstances of water and ice is already known. Such footwear incorporates many methods to deploy and hide the nails as reflected in European Patent 1096867 A which, under the name anti-slipping shoe sole, presents a system to deploy supports inserted in slots or cavities of the shoe sole which incorporates nails and a method to hide them.

Furthermore, there is a trend in several prior inventions to combine materials ordinarily used to manufacture shoe soles with others that incorporate metallic characteristics in order that these latter ones adhere the soles to the floor as reflected in documents ES-U 1034817 and ES-U 139937.

The prior art mentioned above does not foresee, since it only relates to extreme or professional conditions, the existence of a system that thanks to an easy manufacturing and incorporation to all kind of footwear, as in the case of the object of this invention, provides a sole with adherence conditions unknown up to now by the public in general and that solves to a large extent the uncomfortable and dangerous slips in the case of polished surfaces, especially when there is an accumulation of water.

The invention also intends to provide a shock-absorbing effect combined with the above that enhances the comfort of the shoe. In this respect, different devices are known to provide specifically to soles and in general to footwear optimum comfort conditions. However, and as in the previous case, they are confined to a specific sector, in this case sports footwear. Such shock-absorbing systems, such as the one described in document ES-P 2085206 A, are normally bellows studs with a size not advisable for daily-use footwear, both for aesthetic and functional reasons, but that are very useful and appropriate for sports footwear but not for a daily use. Document ES-U 1043453 describes a shock-absorbing system consisting of integral shock-absorbing protuberances that, through complicated successive concentric sections provides a certain shock-absorbing effect.

However, none of the documents belonging to the current state of the art allow to combine both the shock-absorbing and the adherence effects.

Therefore, this invention tries to solve the stiffness and adherence problems of conventional non-sports or professional shoe soles, providing a footwear with optimum shock-absorbing and adherence conditions by means of a system of grooves, concavities and projections of a small size and which can be manufactured in an easy and affordable way.

SUMMARY OF THE INVENTION

The object of this invention is to develop a sole that allows to solve the problems of the previous art. The invention is based on the idea that a particular user must enjoy footwear that guarantees optimum adherence and shock-absorbing characteristics without the need for having recourse to professional shoes or sports footwear, by means of a system that provides such a combination of characteristics in an easy and affordable way.

In accordance with the invention, this object is achieved, as far as the anti-slipping and shock-absorbing element is concerned, by means of the characteristics of claim 1. The additional characteristics are achieved by means of the dependant claims.

Another object of the invention is a shoe sole incorporating a plurality of such anti-slipping and shock-absorbing elements, as defined in claims 4 and 5.

According to the invention, the anti-slipping and shock-absorbing element for shoe soles in the form of a moulded stud provided on a shoe sole incorporating anti-slipping and shock-absorbing means is characterised in that:

it is foreseen as an essentially cylindrical hollow body with a predetermined wall thickness, selected to be compressed under the weight of the user, and with an outer part, i.e., the part that comes into contact with the paving, with an upper base separated from the insole and a lower base level with the sole, and an inner portion, i.e., the part that is facing the sole of the user's foot in the form of a cavity;

a plurality of protuberances of a small height is arranged around the edge of the upper base of such outer portion; a depression or cavity is also formed with the same configuration as the upper base, but slightly off-centred with respect to such upper base;

a surrounding notch in the form of a groove is arranged around the lower base of such outer portion; and a plurality of pins, essentially in the form of a finger are arranged in the inner portion in the form of a cavity, evenly distributed and close to the inner wall of such cavity.

According to an additional characteristic of the invention, at least a groove is formed at the upper base to evacuate water, that extends from the central depression or cavity towards the outer edge.

Other preferred embodiments fall within the scope of the invention, when the hollow body is foreseen as a cylinder with an oval, elliptical or even polygonal base.

Another object of the invention consists of a footwear sole with a plurality of anti-slipping and shock-absorbing elements according to one of the previous claims moulded on it. The sole is preferably moulded with a thermoformed material, such as plastic, rubber, PVC or a mixture of them, or any other material which is suitable from a technical point of view to achieve the degree of elasticity required.

BRIEF DESCRIPTION OF THE DRAWINGS

Other characteristics and advantages of the invention will become apparent from the following detailed description of illustrative embodiments thereof to be read in conjunction with the accompanying drawings with regard to a non limitative embodiment of the invention, where.

Figure 1:
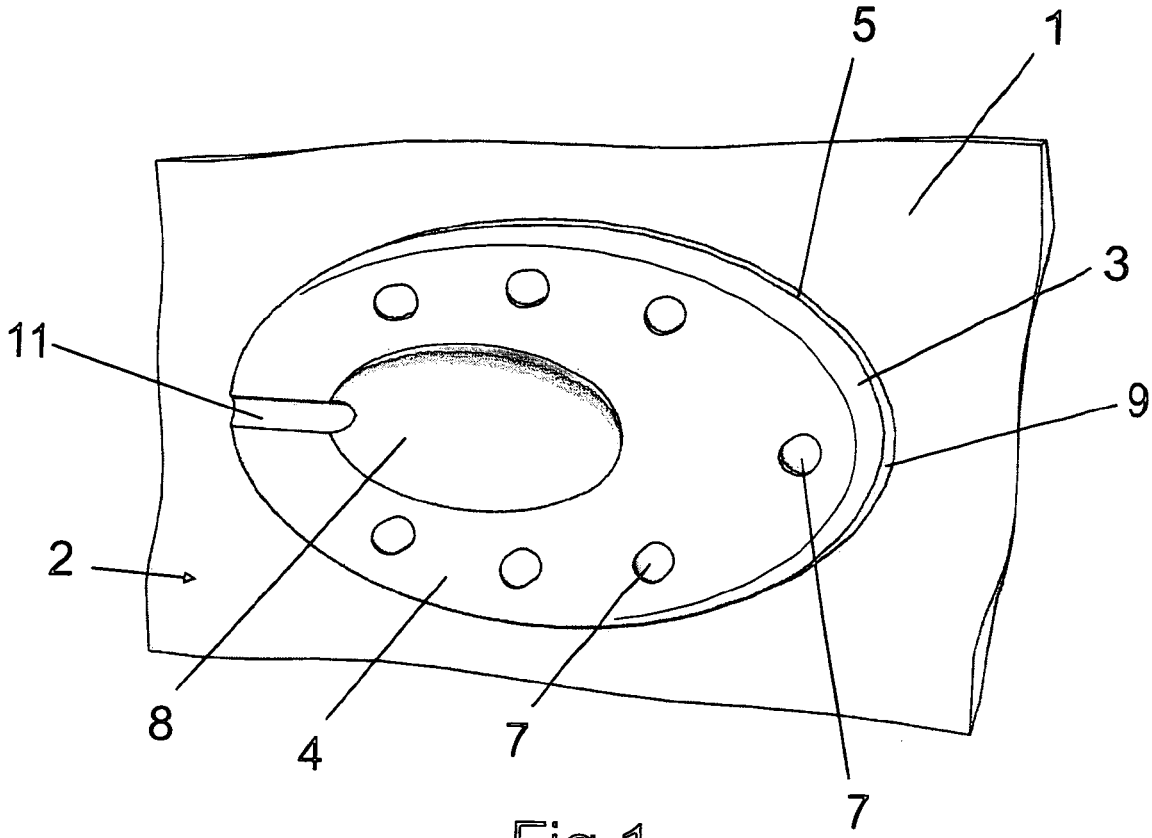
FIG. 1 shows a perspective side view of the outer portion of the anti-slipping and shock-absorbing element according to the invention.
Figure 2:
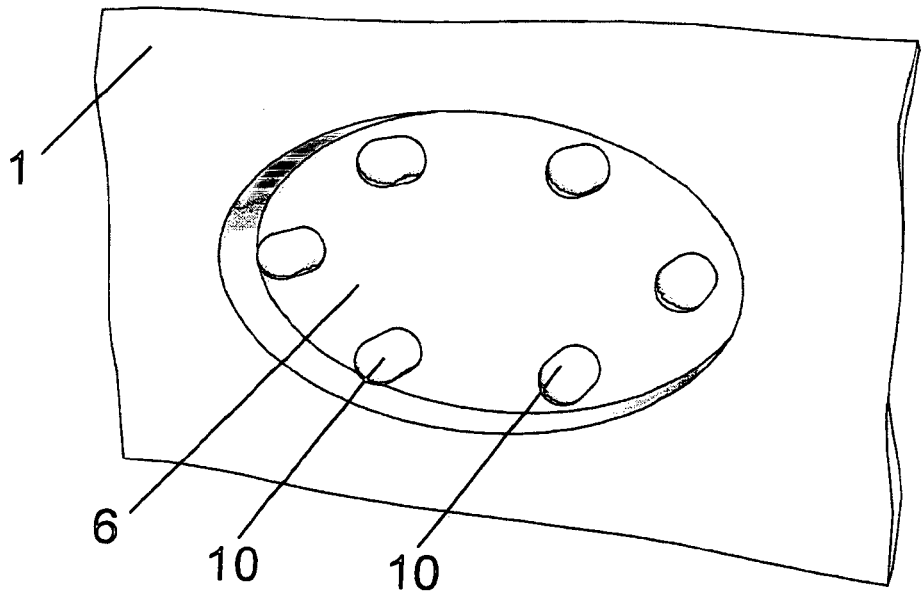
FIG. 2 shows a perspective view of the inner portion of the object of the invention, i.e., the portion that is facing the sole of the user's foot, according to FIG. 1.

As it can be appreciated through the figures, on a footwear sole 1 is arranged an anti-slipping and shock-absorbing element, which will be generally denoted under reference number 2, that generally consists of anti-slipping means and shock-absorbing means arranged as a generally cylindrical hollow body with a predetermined wall thickness, selected so that is can be compressed under the weight of the user, that has an outer portion 3, i.e., the portion that comes into contact with the paving, with an upper base 4 separated from the sole 1, and a lower base 5 level with the sole 1, and an inner portion 6, i.e., the part that is facing the sole of the foot of the user in the form of a cavity;

With special reference to FIG. 1, the anti-slipping means present in such outer portion 3, at the upper base 4, a plurality of protuberances 7 of a small height, distributed around the edge and that will improve the grip of the sole to the paving, by multiplying the number of supports, thus achieving a greater friction with the surface of the paving.

Furthermore, to provide an increased grip to the floor, the upper base 4 of the outer portion 3 shows a depression or cavity 8 with the same configuration as the upper base, but off-centred with respect to such upper base that, once it comes into contact with the paving will produce a suction pad effect, sticking the sole 1 to it and, in summary, providing a better grip.

As far as the shock absorbing means are concerned, the lower base 5 of such outer portion 3 of the sole 1 has a surrounding notch 9 in the form of a groove that, when the sole 1 leans on the paving, allows that the outer portion 3 gives way towards the inner part of the sole 1, thus achieving the desired shock-absorbing effect. Closely related to the above, and to limit the compression of such outer portion 3 under the weight of the user, the inner portion 6, in the shape of a cavity, shows a plurality of pins 10 essentially in the form of a finger, that will be deformed when the outer portion 3 is compressed; however, such deformation is limited, thus providing a padding effect.

The invention, in turn, foresees, in the outer portion 3 of such hollow body, at least a groove 11 extending from the depression or cavity 8 towards the outer edge, and that will allow to evacuate the water that could eventually be trapped inside the depression or cavity 8, thus maintaining the suction pad effect and, consequently, the anti-slipping characteristics of the sole 1. An especially preferred embodiment of the invention is achieved when the anti-slipping and shock-absorbing device is foreseen as a cylinder with an oval or elliptical base, being understood that other suitable shapes, such as circular or polygonal ones, can also be chosen.

Figure 3:
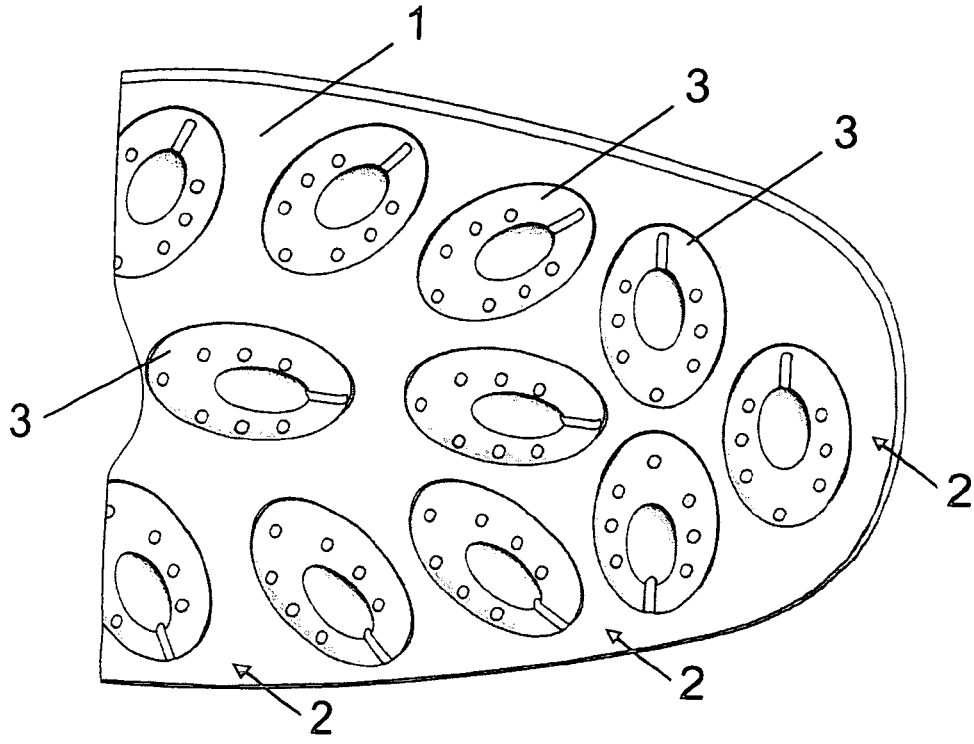
FIG. 3 shows a plan view of a portion of the upper base, i.e., the one that comes into contact with the paving, of a sole according to the invention.
Figure 4:
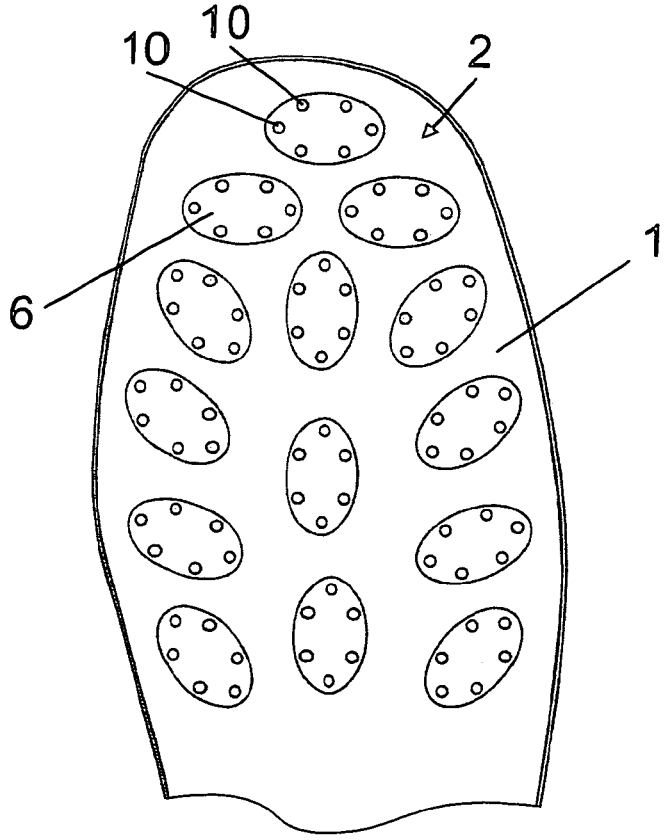
FIG. 4 shows a plan view of a portion of the inner portion, i.e., the one that is facing the sole of the user's foot, of a sole according to the invention.

The footwear sole according to the invention has a plurality of anti-slipping and shock-absorbing elements 2 moulded on it, as it can be observed in FIGS. 3 and 4. It should be mentioned that the number of anti-slipping elements and their distribution throughout the sole 1 should be selected by persons skilled in the art on the basis of the grip and shock absorption requirements needed for each type of footwear and of the visual look of the footwear, so that it becomes acceptable for the user from an aesthetic point of view.

The footwear sole is presented as a moulded sole made of a thermoformed material, such as plastic, rubber, PVC or a mixture of them, or any other material which is suitable from a technical point of view to achieve the degree of elasticity required.

Once the object of the invention has been sufficiently described, it only remains to point out that those embodiments derived from a change in the shape, the materials or other analogous characteristics, as well as those resulting from the routine implementation of the invention disclosed above should be considered as included within the scope of the invention, the scope of which is to be limited only by the appended claims.

I claim:

1. An anti-slipping and shock-absorbing element for footwear soles, comprising:

(a) an outer part for contacting pavement, the outer part comprising an upper base separated from a sole of a shoe, a lower base positioned level with the sole, a cavity formed within the upper base, a plurality of protuberances extending from the upper base and positioned around the cavity, a notch extending from the cavity laterally across the upper base, and a notch surrounding the lower base; and (b) an inner portion defining a cavity facing a sole of a foot and having a plurality of compressable pins positioned on a surface of the inner portion.

2. An anti-slipping and shock-absorbing element for footwear soles according to claim 1, wherein the element has an oval, elliptical of polygonal shape.

3. An anti-slipping and shock-absorbing element for attachment to a footwear sole, comprising:

(a) an outer portion for contacting pavement and compressing, the outer portion comprising:

(i) a lower base portion positioned level with the sole;

(ii) a surrounding notch positioned about the lower base portion and the sole for allowing the outer portion to give way when the outer portion contacts the pavement;

(iii) an upper base portion positioned away from the sole;

(iv) a plurality of protuberances extending from the upper base portion;

(v) a cavity defined within the upper base portion and positioned off-center with respect to the upper base portion; and (vi) a groove extending from the cavity laterally through the upper base portion for evacuating water from the cavity; and;

(b) an inner cavity portion facing a sole of a foot and having a plurality of compressable pins positioned on a surface of the inner cavity portion that compress when the outer portion is compressed.

4. An anti-slipping and shock-absorbing element according to claim 1, wherein the outer portion has an oval, elliptical or polygonal-shape.

5. A shoe, comprising:

a plurality of anti-slipping and shock absorbing elements comprising:

(a) an outer portion for contacting pavement and compressing, the outer portion comprising:

(i) a lower base portion positioned level with the sole;

(ii) a surrounding notch positioned between the lower base portion and the sole for allowing the outer portion to give way when the outer portion contacts the pavement;

(iii) an upper base portion positioned away from the sole;

(iv) a plurality of protuberances extending from the upper base portion;

(v) a cavity defined within the upper base portion and positioned off-center with respect to the upper base portion; and (vi) a groove extending from the cavity through the upper base portion for evacuating water from the cavity; and;

(b) an inner cavity portion facing a sole of a foot and having a plurality of compressable pins positioned on a surface of the inner cavity portion that compress when the outer portion is compressed.

* * * * *